US009953742B2

(12) United States Patent
Brown et al.

(10) Patent No.: US 9,953,742 B2
(45) Date of Patent: Apr. 24, 2018

(54) FOAMED POLYMER SEPARATOR FOR CABLING

(71) Applicant: General Cable Technologies Corporation, Highland Heights, KY (US)

(72) Inventors: Scott M. Brown, Independence, KY (US); Stephen A. Thwaites, Walton, KY (US); Srinivas Siripurapu, Carmel, IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 446 days.

(21) Appl. No.: 13/840,905

(22) Filed: Mar. 15, 2013

(65) Prior Publication Data

US 2014/0262427 A1 Sep. 18, 2014

(51) Int. Cl.

| | |
|---|---|
| ***H01B 11/04*** | (2006.01) |
| ***H01B 3/30*** | (2006.01) |
| ***H01B 17/56*** | (2006.01) |
| ***H01B 7/295*** | (2006.01) |
| *H01B 11/06* | (2006.01) |

(52) U.S. Cl.

CPC ..... *H01B 3/301* (2013.01); *H01B 3/30* (2013.01); *H01B 7/295* (2013.01); *H01B 17/56* (2013.01); *H01B 11/06* (2013.01)

(58) Field of Classification Search

CPC ..... H01B 11/04
USPC ..... 174/113 C, 113 R
See application file for complete search history.

(56) References Cited

U.S. PATENT DOCUMENTS

| | | | | |
|---|---|---|---|---|
| 4,308,352 | A | 12/1981 | Knaus | |
| 4,543,368 | A | 9/1985 | Smearing et al. | |
| 5,619,016 | A | 4/1997 | Newmoyer | |
| RE37,010 | E | 1/2001 | Newmoyer | |
| 6,506,976 | B1 * | 1/2003 | Neveux, Jr. ..... | 174/113 R |
| 6,818,832 | B2 | 11/2004 | Hopkinson et al. | |
| 7,196,271 | B2 * | 3/2007 | Cornibert et al. ..... | 174/113 C |
| 7,271,343 | B2 | 9/2007 | Clark | |
| 7,999,184 | B2 * | 8/2011 | Wiebelhaus et al. ..... | 174/113 R |

(Continued)

FOREIGN PATENT DOCUMENTS

| | | | |
|---|---|---|---|
| JP | 2002-208316 A | | 7/2002 |
| JP | 2007-197568 | * | 8/2007 |

OTHER PUBLICATIONS

Nguyen, Chau N.; Non-final Office Action issued in U.S. Appl. No. 14/310,413; dated Sep. 9, 2014; 11 pages.

(Continued)

*Primary Examiner* — Chau N Nguyen
(74) *Attorney, Agent, or Firm* — Ulmer & Berne LLP

(57) ABSTRACT

A cable separator comprising a preshaped article having a longitudinal length, wherein said preshaped article is substantially entirely formed of a foamed polymer material having a glass transition temperature greater than 160° C. and being halogen-free is provided. A data communications cable comprising a plurality of conductors and the cable separator of the present invention, wherein said cable separator separates the plurality of conductors is provided. A method of manufacturing a cable comprising the separator of the invention is also provided.

15 Claims, 3 Drawing Sheets

(56) References Cited

U.S. PATENT DOCUMENTS

| | | | |
|---|---|---|---|
| 2005/0255741 | A1 | 11/2005 | Ashida et al. |
| 2006/0125136 | A1 | 6/2006 | Kratzmuller |
| 2007/0149629 | A1* | 6/2007 | Donovan et al. ..... 521/134 |
| 2009/0163609 | A1 | 6/2009 | Lassor et al. |
| 2009/0163610 | A1 | 6/2009 | Lanning et al. |
| 2009/0236120 | A1 | 9/2009 | Wiebelhaus et al. |
| 2010/0200269 | A1† | 8/2010 | Camp, II |
| 2010/0326697 | A1* | 12/2010 | Venkataraman et al. ..... 174/110 SR |
| 2011/0220390 | A1 | 9/2011 | Szylakowski et al. |
| 2011/0284287 | A1 | 11/2011 | Glew |
| 2012/0061120 | A1 | 3/2012 | Harada et al. |
| 2013/0037302 | A1 | 2/2013 | Kroushl et al. |
| 2013/0048338 | A1 | 2/2013 | Suzuki et al. |
| 2014/0069687 | A1† | 3/2014 | Tryson |

OTHER PUBLICATIONS

Kim, Tae Hoon; International Search Report and Written Opinion of the International Searching Authority, issued in International Application No. PCT/US2014/024817; dated Jun. 27, 2014; 9 pages.

Nguyen, Chau N.; Final Office Action issued in related U.S. Appl. No. 14/310,413; dated Jan. 28, 2015; Title: Foamed Polymer Separator for Cabling; Filed: Jun. 20, 2014; Inventor(s): Scott M. Brown et al.; 11 pages.

* cited by examiner
† cited by third party

FOAMED POLYMER SEPARATOR FOR CABLING

FIELD OF THE INVENTION

The present application relates to a foamed thermoplastic polymer separator for cabling. More specifically, the foamed thermoplastic polymer separator provides electrical separation between conductors in a cable, such as a data communications cable.

BACKGROUND OF THE INVENTION

Conventional data communications cables typically comprise multiple pairs of twisted conductors enclosed within a protective outer jacket. These cables often include twisted pair separators in order to provide physical distance (i.e., separation) between the pairs within a cable, thereby reducing crosstalk. Conventional separators are typically made of dielectric materials, such as polyolefin and fluoropolymers, which provide adequate electrical insulation.

Standard materials used in the formation of separators, like polyolefins and certain fluoropolymers, are disadvantageous for a number of reasons. In the event a portion of the cable ignites, it is desirable to limit the amount of smoke produced as a result of the melting or burning of the combustible portions (e.g., a separator) of the cable. It is also desirable to prevent or limit the spread of flames along the cable from one portion of the cable to another. The conventional materials used for cable separators have poor smoke and/or flame-retardant properties. Therefore, those materials increase the amount of smoke that is emitted in the event of a fire, as well as the distance that the flame travels along the burning cable. In order to mitigate these drawbacks, some manufacturers add flame retardants and smoke suppressants to the conventional polyolefin and fluoropolymer materials. However, smoke suppressants and flame retardants often increase the dielectric constant and dissipative factors of the separator, thereby adversely affecting the electrical properties of the cable by increasing the signal loss of the twisted pairs within close proximity to the separator. Also, flame retardants and smoke suppressants generally contain halogens, which are undesirable because hazardous acidic gases are released when halogens burn.

Moreover, the addition of the separator also adds weight to the cable. It is desirable to keep the weight of the cable as low as possible, for ease of transporting to the job site and for reducing the requirements on supports within the building, for example. To reduce the impact on electrical performance and also to reduce the weight of the cable, some manufacturers may "foam" the separators in order to reduce the amount of material used. A foamed material is any material that is in a lightweight cellular form resulting from introduction of gas bubbles during the manufacturing process. However, foaming of conventional separator materials only minimally reduces the amount of material used because the amount of foaming is limited by the resulting physical strength of the foam. The separator must have sufficient strength to prevent damage during cable processing or manufacturing. Additionally, crushing or deformation of the foamed separators can occur if the foamed material does not have adequate strength, resulting in compaction and less separation between twisted pairs. As a result, traditional foamed separators often possess undesirable mechanical stability.

Accordingly, in light of those drawbacks associated with conventional separators, there is a need for a cable separator that adequately reduces crosstalk between twisted pairs within the cable, while simultaneously improving the flame spread and smoke emission properties of the cable without the addition of halogens. Cable separators that are structurally sound and as lightweight as possible are also desirable.

SUMMARY OF THE INVENTION

Accordingly, an exemplary embodiment of the present invention provides a cable separator comprising a preshaped body having a longitudinal length, wherein the preshaped article is substantially entirely formed of a foamed thermoplastic polymer having a glass transition temperature above 160° C. and being halogen-free.

The present invention may also provide a data communication cable comprising a plurality of conductors and a separator. The separator includes a preshaped body having a longitudinal length, wherein the preshaped body is substantially entirely formed of a foamed thermoplastic polymer having a glass transition temperature above 160° C. and being halogen-free. The separator separates the plurality of conductors.

The present invention may also provide a method of making a cable including the steps of providing a foamed thermoplastic polymer having a glass transition temperature above 160° C. and being halogen-free, and extruding the foamed polymer material to form a separator having a predetermined shape. A plurality of conductors is then provided. The separator is positioned between the plurality of conductors after forming the separator having the predetermined shape and without further manipulation of the separator. An outer jacket is then extruded that surrounds the separator and the plurality of conductors.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
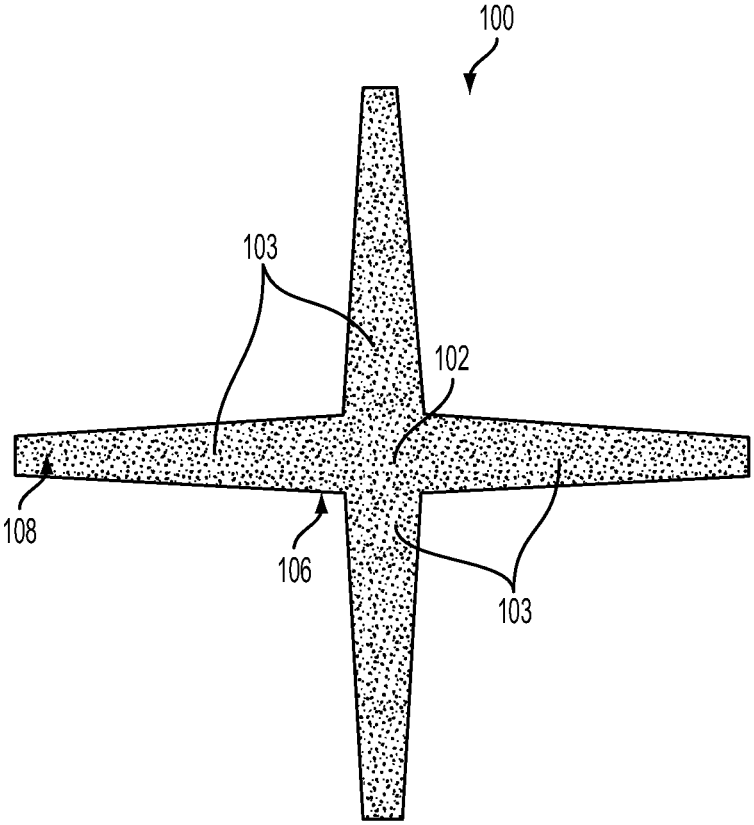
FIG. 1 is cross-sectional end view of a foamed separator for cabling in accordance with an exemplary embodiment of the present invention.
Figure 2A:
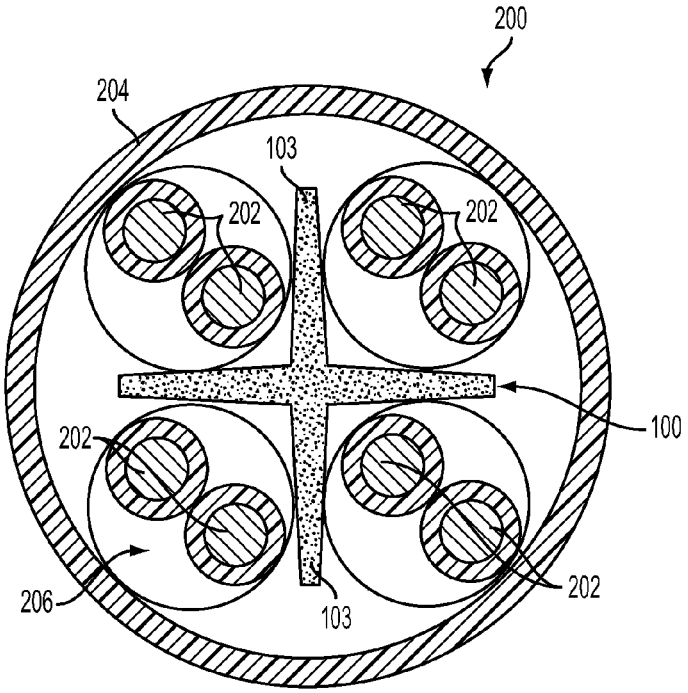
FIG. 2A is a cross-sectional end view of a data communication cable including the foamed separator illustrated in FIG. 1, in accordance with an exemplary embodiment of the present invention.

Referring to FIGS. 1 and 2A, a cable separator 100 according to an exemplary embodiment of the present invention generally comprises a preshaped body 102 having a longitudinal length that is preferably substantially entirely formed of a foamed thermoplastic polymer material. The foamed polymer material is a high-performance thermoplastic polymer having a glass transition temperature above 160° C. and is halogen-free. Use of the foamed polymer to form the cable separator improves the smoke and flame resistance of the resulting cable, improves the electrical performance of the cable, improves the rigidity (and thus structural integrity) of the separator, and decreases the weight of the overall cable.

The preshaped body 102 of the separator 100 may take any variety of shapes, provided that the selected shape is suitable to provide conductor separation in a data communication cable 200. As shown in FIG. 1, the separator body 102 may form a substantially crossweb shape. The separator body 102 may comprise one or more projections 103 extending outwardly from the longitudinal length of the body 102. That is, the projections 103 extend outwardly from a center of the body 102. As depicted in FIG. 1, the separator 100 preferably has four projections 103, although any number of projections 103 may be used. In at least one embodiment, the separator 100 comprises four preshaped projections 103 extending from the center of the body 102, whereby each projection 103 is perpendicular to the adjacent projection 103.

Each projection 103 may have a first end 106 originating from a center of the body 102 and a second end 108 at which the projection 103 terminates. Along the length of the projection 103, between the first end 106 and the second end 108, the projection 103 may taper. Specifically, the projection 103 may be thickest at its first end 106 and narrowest at its second end 108.

According to one embodiment, the body 102 may be about 0.025-0.035 inches wide (not including the width of the projections 103), and the separator 100 as a whole may be about 0.14-025 inches in width and height.

Figure 2B:
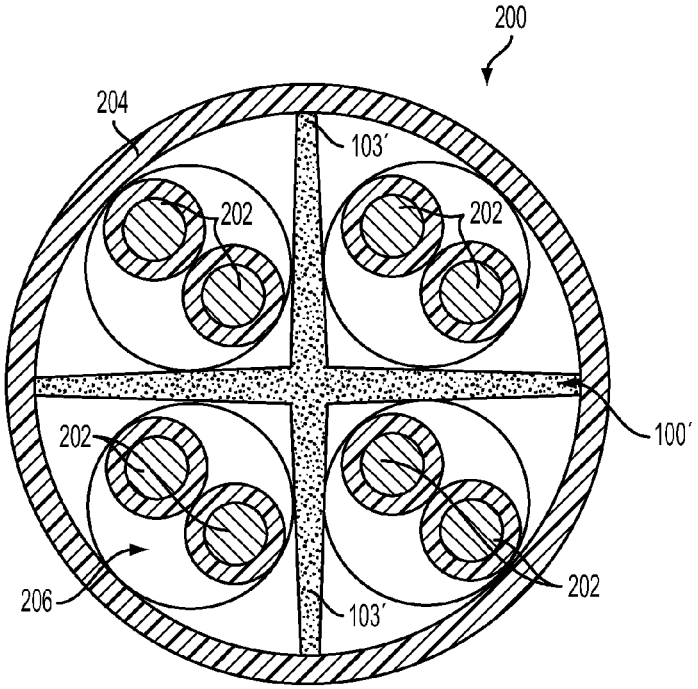
FIG. 2B is a cross-sectional end view of a data communication cable in accordance with an exemplary embodiment of the present invention.

Referring to FIG. 2B, a separator 100' according to another exemplary embodiment of the present invention is substantially the same as the separator 100 of FIG. 2A, except that it preferably has larger dimensions. More specifically, the separator 100' is sized such that the projections 103' of the preshaped body 102' preferably extend to the jacket of the cable.

Figure 2C:
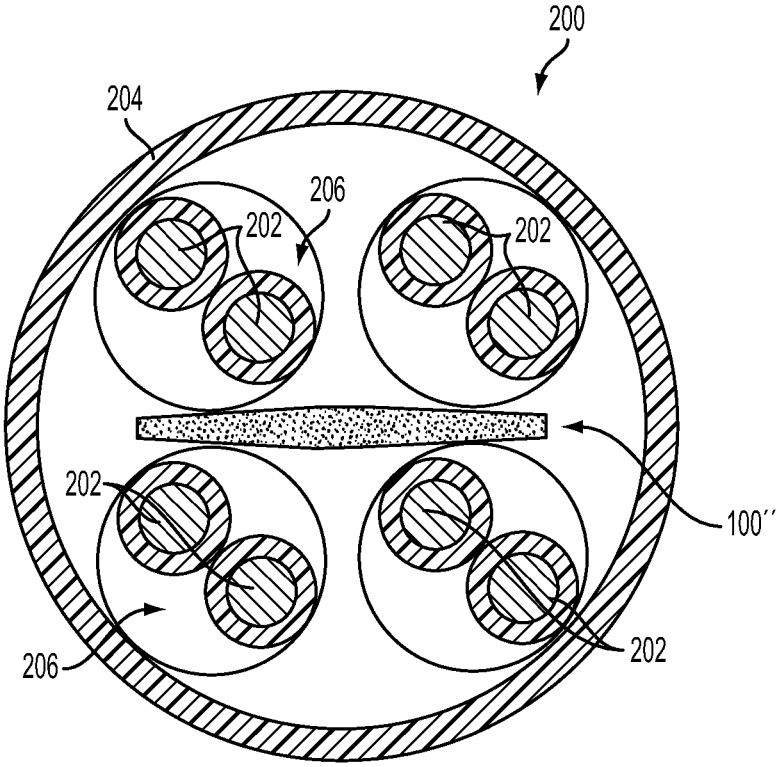
FIG. 2C is a cross-sectional end view of a data communication cable in accordance with an exemplary embodiment of the present invention.

Referring to FIG. 2C, a separator 100" according to yet another exemplary embodiment of the present invention may be preshaped in the form of a substantially flat member. The substantially flat member may be a tape, for example. The substantially flat separator 100" may have a wider center with narrowing ends.

In all embodiments, the separator is substantially entirely formed of a foamed high-performance thermoplastic polymer, which has a glass transition temperature above 160° C. and which is halogen-free. Materials which are halogen-free contain less than 900 parts per million (ppm) of either chlorine or bromine, and less than 1500 ppm total halogens. A high-performance polymer with a high glass transition temperature (above 160° C.) has high flame retardance/resistance and low smoke emission when subjected to a flame. Further, high-performance thermoplastic polymers have inherently high strength and toughness, which improves their mechanical performance in a variety of high-stress applications. High-performance polymer materials suitable for forming the separator of the present invention include, but are not limited to, polyethersulfone, poly(arylether sulfone), poly(biphenylether sulfone), polysulfone, polyetherimide, polyphenylene, polyimide, polyphenylsulfone, polyphenylenesulfide, poly(aryletherketone), poly(etheretherketone), and blends thereof. According to one embodiment, the polymer materials may be homopolymers, copolymers, alternating copolymers or block copolymers. If the material is a copolymer of the above-mentioned polymers, it is preferably a siloxane copolymer thereof.

Unlike conventional materials used to form separators, no smoke suppressants or flame retardants need to be added to the polymer foam of the present invention to meet the mandatory burn performance required by federally regulated standards. Thus, the separators of the present invention need not include any halogen-containing additives. As a result, in the event of a fire, no hazardous acidic gasses would be released. Further, it is advantageous that no additives are needed for the separator, because they increase the effective dielectric constant and dissipative factors of the separator, thus increasing signal loss of the cable.

The smoke and flame spread performance of a conventional halogen-containing ethylene chlorotrifluoroethylene (ECTFE) material is compared to halogen-free 50% foamed PEI in Table 1 below. Specifically, crossweb separators made of each material were incorporated into two different cables—Construction 1 and Construction 2. Construction 2 is simply a larger cable, having a larger crossweb, than Construction 1. The burn performance was tested according to the National Fire Protection Association (NFPA) standards, specifically NFPA 262. Smoke performance is measured by the average optical density and peak optical density of smoke. As can be seen, the PEI foam exhibited improved smoke performance and comparable flame spread performance over the conventional ECTFE for both cable constructions. Further, the PEI foam exhibited the same flame spread performance as ECTFE for Construction 1, and improved flame spread performance over ECTFE for Construction 2. The PEI foam separators meet all federally regulated standards, which require five feet or less of flame spread, a maximum of 0.15 average optical density of smoke, and a maximum of 0.50 peak optical density of smoke.

TABLE 1

Smoke and Flame Performance of Various Polymer Materials

| | Construction 1 | | Construction 2 | |
|---|---|---|---|---|
| | ECTFE | PEI Foam | ECTFE | PEI Foam |
| Flame spread (ft) | 1.0 | 1.0 | 2.0 | 1.5 |
| Average Optical Density (smoke) | 0.14 | 0.10 | 0.12 | 0.08 |
| Peak Optical Density (smoke) | 0.29 | 0.20 | 0.30 | 0.21 |

The separators of the exemplary embodiments of the present invention are "preshaped" in that they are manufactured into a desired shape which is maintained during the cable construction and thereafter. Using a preshaped separator is beneficial in that once the separator is formed, it does not require further configuring or arranging to create a desired shape for use in a cable. That is, the cable manufacturing process is streamlined by preshaping or preforming the separator and thus requiring no further manipulation of the separator when completing the cable construction (e.g., adding a jacket and twisted wire pairs). The polymer foam preferably has, however, enough flexibility to allow it to be constructed into the cable, while also having sufficient rigidity such that it will substantially maintain its shape during manufacture, installation and use of the cable. The rigidity of the polymer separator adds structure and stiffness to the cable, which is desirable to prevent kinking of the cable, such as during the pulling out process from the cable packaging. A stiffer cable also reduces sag between support points in a building, thereby reducing drag during installation.

High-performance polymers which have higher tensile strength, tensile modulus, flexural strength and flexural modulus as compared to other materials are well suited for forming separators. Materials having higher tensile/modulus are stiffer than materials with lower tensile strength/modulus and are not as easily deformed when forces are applied to them. Materials having higher flexural strength and flexural modulus resist bending better than materials with lower flexural strength/modulus and are also not as easily deformed when a flexural force is applied to them. Tensile strength/modulus was measured for a variety of conventional polymer materials according to Active Standard ASTM D638, and flexural strength/modulus was measured for the same polymer materials according to Active Standard ASTM D790. As can be seen in Table 2 below, polyetherimide (PEI) and polyphenylsulfone (PPSU), both halogen-free, outperform conventional halogenated materials, such as, fluorinated ethylene propylene (FEP), ethylene chlorotrifluoroethylene (ECTFE), perfluoromethylalkoxy (MFA) and flame-retardant polyethylene (FRPE) in tensile strength, tensile modulus, flexural strength and flexural modulus. The PEI and PPSU materials, both of which are high-performance polymers, also outperform high density polyethylene (HDPE), which is not a high-performance polymer, in the same categories. The flexural strength of FEP and MFA is so low that neither can be reliably measured.

TABLE 2

Material Properties of Various Polymer Materials

| | FEP | HDPE | ECTFE | MFA | PEI | FRPE | PPSU |
|---|---|---|---|---|---|---|---|
| Halogenated? | Yes | No | Yes | Yes | No | Yes | No |
| Specific gravity | 2.17 | 1.2 | 1.68 | 2.15 | 1.27 | 1.20-1.65 | 1.29 |
| Tensile Strength (Mpa) | 27 | 24 | 54 | 32 | 110 | 16-17 | 70 |
| Tensile Modulus (MPa) | 345 | 1030 | 1650 | 500 | 3580 | 1100 | 2340 |
| Flexural Strength (MPa) | — | 40 | 50 | — | 165 | 17 | 90 |
| Flexural Modulus (MPa) | 520 | 1520 | 1370 | 650 | 3510 | 510 | 2410 |

By foaming the polymer of the separators of the present invention, the amount of material needed to form the separator is significantly reduced as compared to conventional cable separators, thereby reducing the overall weight of the cable and reducing the amount of flame and smoke producing material. As can be seen in Table 2, some of the high-performance polymer materials also have lower specific gravity than conventional polymer materials, thus further reducing the weight of the resulting separator. High-performance polymers which have glass transition temperatures above 160° C. are preferred because they have high tensile strength which allows for higher foam rates to be achieved, while still maintaining the required strength needed for processing and manufacture. The polymer separators of the present invention may have foam rates of between 30% and 80%, which is significantly higher than the conventional cable construction materials. At higher foam rates, the conventional materials are susceptible to crushing and deformation, thereby jeopardizing the electrical properties of the cable.

One further advantage of the polymer foam involves its use in plenum style communication cables. The use of conventional polymer materials for separators in plenum style cables requires special manufacturing equipment, as these polymers are highly corrosive to unprotected metals. Special corrosion-resistant metals, such as austenitic nickel-chromium based super alloys (i.e., Inconel® and Hastelloy®), must therefore be used. The specialty equipment required to process these materials is expensive, so the use of certain high-performance polymers, such as PEI and PPSU, to form separators provides the added advantage of reducing manufacturing costs.

The separator may be formed using melt processable materials, such as foamed or solid polymers or copolymers. The separator may be foamed through a chemical process, using gas injection or other such methods known to one skilled in the art to achieve uniform fine air bubbles throughout the cross-section of the separator. As is known to one skilled in the art, polymer resins may be foamed with the use of one or more blowing agents. Examples of blowing agents include, but are not limited to, inorganic agents, organic agents, and chemical agents. Examples of inorganic blowing agents include, without limitation, carbon dioxide, nitrogen, argon, water, air nitrogen, and helium. Examples of organic blowing agents include, without limitation, aliphatic hydrocarbons having 1-9 carbon atoms, aliphatic alcohols having 1-3 carbon atoms, and fully and partially halogenated aliphatic hydrocarbons having 14 carbon atoms. Exemplary aliphatic hydrocarbons that may be used include, without limitation, methane, ethane, propane, n-butane, isobutane, n-pentane, isopentane, neopentane, and the like. Exemplary aliphatic alcohols include, without limitation, methanol, ethanol, n-propanol, and isopropanol. Fully and partially halogenated aliphatic hydrocarbons can be used and include, without limitation, fluorocarbons, chlorocarbons, and chlorofluorocarbons. Examples of fluorocarbons include methyl fluoride, perfluoromethane, ethyl fluoride, 1,1-difluoroethane (HFC-152a), 1,1,1-trifluoroethane (HFC-143a), 1,1,1,2-tetrafluoroethane (HFC-134a), pentafluoroethane, difluoromethane, perfluoroethane, 2,2-difluoropropane, 1,1,1-trifluoropropane, perfluoropropane, dichloropropane, difluoropropane, perfluorobutane, perfluodichloropropane, difluoropropane, perfluorobutane, perfluorocyclobutane. Partially halogenated chlorocarbons and chlorofluorocarbons for use in this invention include methyl chloride, methylene chloride, ethyl chloride, 1,1,1-trichloroethane, 1,1-dichloro-1-fluoroethane (HFC-141b), 1-chloro-1,1-difluoroethane (HCFC-142), chlorodifluoromethane (HCFC-22), 1,1-dichloro-2,2,2-trifluoroethane (HCFC-123) and 1-chloro-1,2,2,2-tetrafluoroethane (HCFC-124). Fully halogenated chlorofluorocarbons include trichloromonofluoromethane (CFC-11), dichlorodifluoromethane (CFC-12), trichlorotrifluoroethane (CFC-113), 1,1,1-trifluoroethane, pentafluoroethane, dichlorotetrafluoroethane (CFC-114), chloroheptafluoropropane, and dichlorhexafluoropropane. However in preferred embodiments, the blowing agents used to foam the separators are halogen-free. Examples of chemical blowing agents that can be used include, without limitation, azodicarbonaminde, azodiisobutyronitrile, benzenesulfonhydrazide, 4,4-oxybenzene sulfonylsemicarbazide, p-toluene sulfonyl semicarbazide, barium azodicarboxylate, N,N'-dimethyl-N,N'-dinitrosoterephthalamide, trihydrazino triazine and 5-phenyl-3,6-dihydro-1,3,4-oxadiazine-2-one. As in known in the art, the blowing agents may be used in various states (e.g., gaseous, liquid, or supercritical).

As shown in FIGS. 2A, 2B and 2C, separators 100, 100' and 100" of the present invention may be used in a data communication cable 200 for separating a plurality of conductors 202. While not limited to such an embodiment, the plurality of conductors 202 may be organized into twisted conductor pairs 206. In that construction, the separator physically separates each of the twisted conductor pairs 206. The data communication cable 200 may also comprise a protective jacket 204 which surrounds the conductors 202.

As shown in FIG. 2A, the projections 103 of the separator 100 may extend sufficiently far so as to provide physical separation between the conductor pairs 206, but not as far as the inside of the projective jacket 204. Alternatively, as shown in FIG. 2B, the projections 103' of the separator 100' may extend to the inside of the protective jacket 204 without extending beyond the conductor pairs 206.

As shown in FIG. 2C, the separator 100" may be preshaped as a substantially flat member. The substantially flat member may be in the form of a tape, for example. In this embodiment, the separator 100" generally forms two channels to separate one group of conductor pairs 206 from another group of conductor pairs 206.

To construct the data communication cable of the present invention, a separator is first formed by extruding the foamed polymer material of the present invention into a predetermined shape. According to one embodiment, the predetermined shape may be a crossweb. According to yet another embodiment, the predetermined shape may be a substantially flat member. Next, a plurality of conductors is provided, and the separator is positioned between groupings of the conductors. With a crossweb shape, the separator separates the plurality of conductors into four groupings. With a substantially flat member shape, the separator separates the plurality of conductors into two groupings. The separator has a predetermined shape, thus no manipulation is needed when positioning the separator between the conductors. Lastly, an outer jacket is extruded. The outer jacket surrounds the separator and the plurality of conductors, and its application requires no further manipulation of the separator.

While particular embodiments have been chosen to illustrate the invention, it will be understood by those skilled in the art that various changes and modifications can be made therein without departing from the scope of the invention as defined in the appended claims.

What is claimed is:

1. A cable separator, comprising:

a preshaped body having a longitudinal length, wherein said preshaped body is substantially entirely formed of a foamed thermoplastic polymer selected from the group consisting of polyphenylenesulfide, poly(aryletherketone), poly(etheretherketone), and blends thereof; and wherein the preshaped body is halogen-free.

2. The cable separator according to claim 1, wherein said foamed thermoplastic polymer has a foam rate of between 30% and 80%.

3. The cable separator according to claim 1, wherein said preshaped body includes one or more projections extending in an outward direction.

4. The cable separator according to claim 3, wherein, said preshaped body is a crossweb.

5. The cable separator according to claim 1, wherein said preshaped body is a substantially flat member.

6. A data communication cable, comprising:

a plurality of conductors; and a separator, including:

a preshaped body having a longitudinal length, wherein said preshaped body is substantially entirely formed of a foamed thermoplastic polymer selected from the group consisting of polyphenylenesulfide, poly(aryletherketone), poly(etheretherketone), and blends thereof; and wherein the preshaped body is halogen-free, and wherein said separator separates said plurality of conductors.

7. The data communication cable according to claim 6, wherein said foamed thermoplastic polymer has a foam rate of between 30% and 80%.

8. The data communication cable according to claim 6, wherein said preshaped body includes one or more projections extending in an outward direction.

9. The data communication cable according to claim 8, wherein said preshaped body is a crossweb.

10. The data communication cable according to claim 6, wherein said preshaped body is a substantially flat member.

11. The data communication cable according to claim 6, wherein said plurality of conductors comprises a plurality of twisted conductor pairs.

12. The data communication cable of claim 6, further comprising a protective jacket surrounding said plurality of conductors.

13. A method of manufacturing a cable, comprising the steps of:

providing a foamed thermoplastic polymer selected from the group consisting of polyphenylenesulfide, poly(aryletherketone), poly(etheretherketone), and blends thereof;

extruding said foamed thermoplastic polymer to form a separator having a predetermined shape, the separator being halogen-free;

providing a plurality of conductors;

positioning said separator between said plurality of conductors after forming said separator having said predetermined shape and without further manipulation of said separator; and extruding an outer jacket that surrounds said separator and said plurality of conductors.

14. The method of claim 13, wherein said predetermined shape is a crossweb.

15. The method of claim 13, wherein said predetermined shape is a substantially flat member.

* * * * *